United States Patent [19]

Senft

[11] 4,330,992

[45] May 25, 1982

[54] DRIVE MECHANISM FOR STIRLING ENGINE DISPLACER AND OTHER RECIPROCATING BODIES

[75] Inventor: James R. Senft, Athens, Ohio

[73] Assignee: Sunpower, Inc., Athens, Ohio

[21] Appl. No.: 140,127

[22] Filed: Apr. 11, 1980

[51] Int. Cl.[3] ..... F02G 1/04

[52] U.S. Cl. ..... 60/518; 74/44

[58] Field of Search ..... 60/517, 518; 74/25, 74/44, 828; 92/13.3, 60, 75

[56] References Cited

FOREIGN PATENT DOCUMENTS 58849 2/1947 Netherlands ..... 60/518

528205 10/1940 United Kingdom ..... 60/517

*Primary Examiner*—Robert G. Nilson

*Attorney, Agent, or Firm*—Frank H. Foster

[57] ABSTRACT

A mechanism is disclosed for driving the displacer of a crank-type Stirling engine at the same frequency but out of phase with the power piston of the engine. A biasing means is linked to the displacer for applying a biasing force which urges the displacer in one direction of its reciprocation. A flexible band is secured to the displacer for applying a force opposite to the biasing force. The other end of the band is secured to an anchor which is mounted on another part of the apparatus. The band extends slideably across at least one and preferably two bearing surfaces intermediate its secured ends.

25 Claims, 8 Drawing Figures

DRIVE MECHANISM FOR STIRLING ENGINE DISPLACER AND OTHER RECIPROCATING BODIES

TECHNICAL FIELD

This invention relates generally to mechanisms for converting rotary motion to reciprocating motion and more particularly relates to a drive mechanism for driving the displacer of a crank-type Stirling engine.

BACKGROUND ART

There are two general types of Stirling engines. In the first, the piston and displacer are mechanically linked to a rotating shaft by means of a linkage means for converting between rotary motion and reciprocating motion. The most common linkage of this type is the conventional crankshaft and connecting rod linkage means. The second type of Stirling engine is the free piston Stirling engine. The present invention is not applicable to free piston Stirling engines but is applicable to the first type as well as to other devices in which there is a need for a linkage which converts rotary motion to reciprocating motion and in which it is desired to have a selected phase relationship between two reciprocating bodies linked to a rotating shaft.

Although a variety of linkages are shown in the prior art, those which have been applied to Stirling engines include not only the conventional crank and connecting rod, but also the rhombic drive, bell cranks, cams and wobble plates.

In the Stirling engine, the purpose of the linkage means which connects the piston to the rotating shaft is to transfer energy from the moving piston to the rotating shaft. The purpose of the linkage means which connects the displacer to the rotating shaft is to reciprocate the displacer in the working fluid at the proper phase and with the proper waveform or translation characteristic in order to obtain the desired operation of the engine.

BRIEF DESCRIPTION OF THE INVENTION

The present invention is a new linkage means for converting rotary motion to reciprocating motion. It is particularly useful for controlling the displacer of a Stirling engine or heat pump but is also applicable to other reciprocating bodies.

The Stirling engine may be described as comprising a housing or support frame in which a power piston and displacer are mounted for reciprocation in one or more cylinders formed in the housing. Each of these two reciprocating bodies are linked to a rotating shaft by means of a linkage for converting between rotary motion and reciprocating motion.

Embodiments of the present invention link a reciprocating body such as the displacer of a Stirling engine to the rotating shaft so that the displacer or other body will be reciprocated at the same frequency as the power piston but out of phase with it.

The invention comprises a biasing means, such as a spring, which is linked to the displacer for applying a biasing force upon the displacer urging it in one direction of its reciprocation. A flexible band is secured at a place along its length to the displacer and extends away from the displacer in a direction for applying a force on the displacer opposite to the biasing force when the band is in tension. A band can not, of course, apply a significant compressive force. It can pull but not push.

The other end of the band is secured to an anchor. The anchor is mounted either to the housing or support frame of the engine or the anchor is mounted to the linkage means which connects the power piston to the crank shaft.

Intermediate the place on the band where it is attached to the displacer and the places where it is secured to an anchor, the band extends slideably across at least one bearing surface and preferably across two bearing surfaces. The bearing surface is formed on another part of the apparatus which is different from the parts to which the band is secured. Thus, if the band is secured to the displacer and the housing, at least one bearing surface will be formed on the power piston linkage means. In the alternative, if the band is secured between the displacer and the power piston linkage means, then at least one such bearing surface will be formed on or mounted to the housing.

This is a major simplification of the Stirling engine because it can use a single throw crank, have less reciprocating mass while also reducing lubrication requirements. Additionally, embodiments of the present invention permit adjustment of the phase between the reciprocating piston and the displacer in an extremely easy manner which, with some embodiments, can even be done while the engine is operating. Further, the invention facilitates the design and adjustment of displacer stroke and average position.

DESCRIPTION OF THE PREFERRED AND ALTERNATIVE EMBODIMENTS

Figure 1:
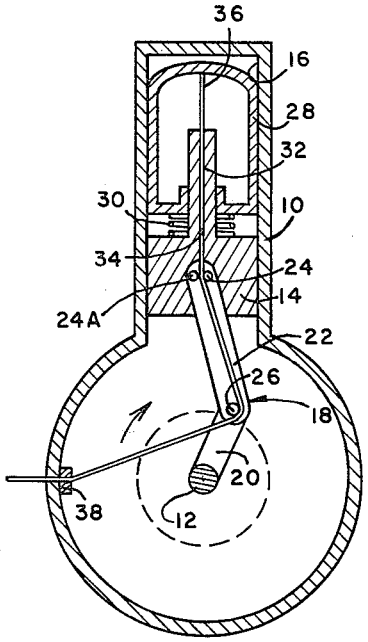
FIG. 1 is a diagrammatic view of the preferred embodiment of the invention.

FIG. 1 diagrammatically illustrates a Stirling engine having a housing 10, a crankshaft 12 which is rotatably journalled to the housing 10, a cylinder 16 formed in the housing 10 and a power piston 14 mounted for reciprocation in the cylinder 16. The power piston 14 is linked to the crankshaft 12 by means of a linkage means 18 for converting the reciprocating motion of the piston to the rotary motion of the crankshaft 12.

The particular linkage means for the power piston 14 is a conventional crank 20 formed on the crankshaft 12 and linked to the piston 14 by means of the connecting rod 22. The connecting rod is connected to the piston 14 by means of a wrist pin 24 and to the crankshaft 12 by a crank pin 26.

A displacer 28 is also reciprocally mounted in the same cylinder 16. The displacer 28 is slideably mounted on a coaxial shaft 32 extending upwardly from the power piston 13, all in the conventional manner.

A biasing means in the form of a compression spring 30 is positioned between the displacer 28 and the power piston 14. The spring 30 is a biasing means which urges the displacer in an upward direction away from the piston 14.

A flexible band 34 is connected at one end 36 to the displacer 28 and extends slideably across a bearing surface formed at the wrist pin 24 and a second bearing surface formed at the crank pin 26 to a fixed connection at an anchor 38 mounted to the housing.

The band 34 pulls downwardly in tension on the displacer 28 to apply a force opposite to the force applied by the spring 30. The band 34 has a length which will maintain at least some minimum compression on the spring 30 during the entirety of the cycle so that there is always a tension on the band 34 providing a static force equal and opposite to the static force of the spring 30.

Although the term "band" has been selected to describe the structure, the band 34 merely need be a flexible, tension-transmitting member. The band may be embodied in a variety of shapes and materials and could be termed a belt, chain, rope, cable, cord, strip, tape, strand, wire, etc., or any one of a variety of equivalent structures.

In FIG. 1 the band extends across bearing surfaces formed at wrist pin 24 and crank pin 26. These bearing surfaces can be embodied in a variety of different structures. They can, in the simpliest form be formed of extensions of the actual wrist pin and crank pin.

Alternatively, and preferably, they are separate structures mounted at the same region of the mechanism. Additionally, while they may be smooth surfaces machined on a pin or other part of the machine, they are preferably anti-friction devices such as rotatable pins or pulleys mounted to the linkage means or housing by appropriate anti-friction bearnings.

Desirably, a second pin 24A is mounted adjacent the portion of the wrist pin which contacts the band to retain the sliding band against one of the pins during the entire cycle.

As a further alternative, the band may have cogs, teeth or spaced openings instead of being smooth and the bearing surfaces may be mating gears or sprockets, etc., so that the band and the bearing surfaces are matingly meshed.

Therefore, the term "extending slideably" over a bearing surface are merely words selected to include the variety of different forms that the invention may take and is not limited to an actual, direct, frictional sliding between the band and the bearing surfaces. The term includes equivalent structures.

Figure 2A:
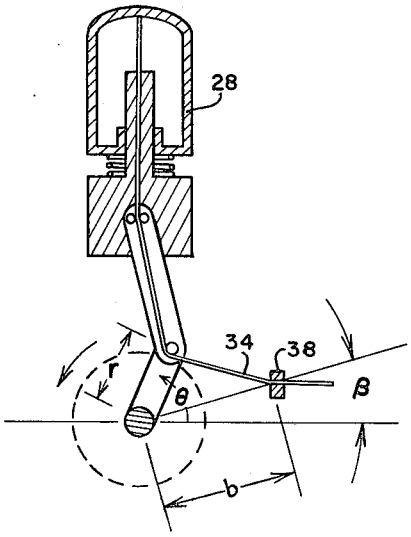
FIG. 2A is a diagram illustrating the mathematical model used to derive the graph of FIG. 2B.
Figure 2B:
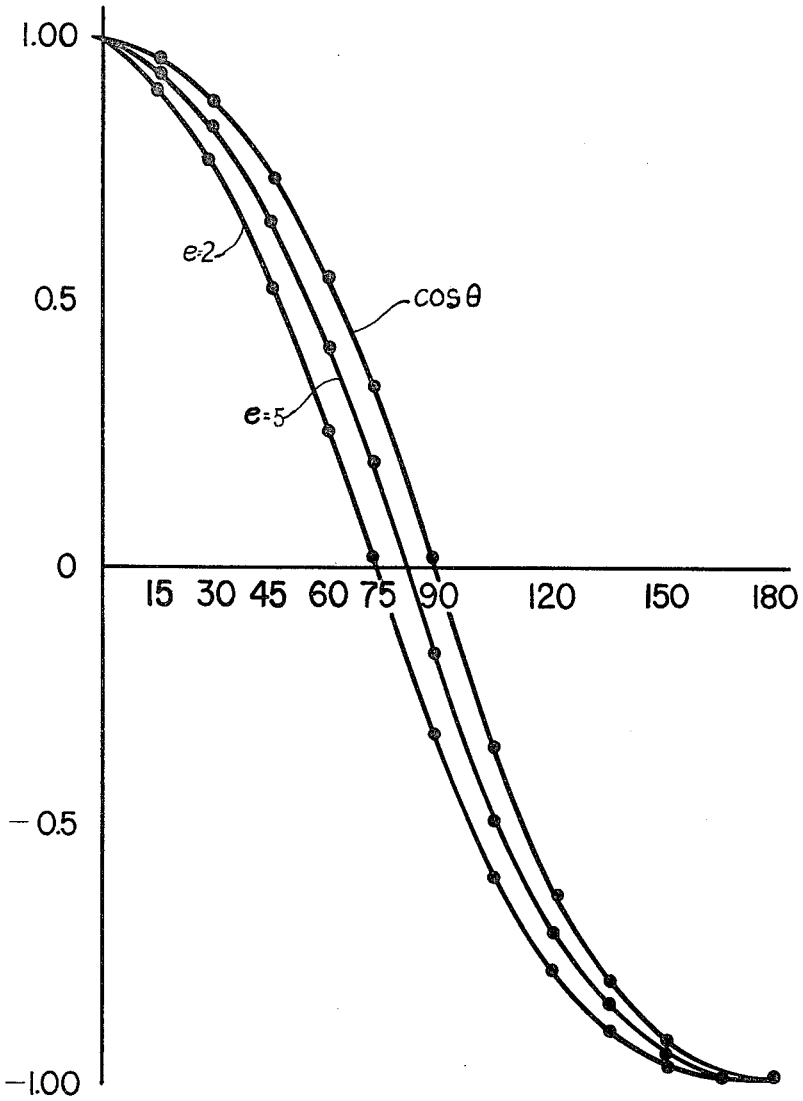
FIG. 2B is a graphical illustration comparing the motion of a displacer in an embodiment of the invention to perfectly sinusoidal motion.

The motion of a displacer in a Stirling engine embodying the present invention is illustrated in FIGS. 2A and 2B. The motion may be described from geometrical considerations with reference to FIG. 2A by the equation:

$$y = r[1 + e - \sqrt{1 + e^2 - 2e\cos\theta}\ ] \qquad \text{Eq. I}$$

where y is the position of the displacer above the power piston, r and $\theta$ are shown in FIG. 2A and e is a dimensionless term for normalizing the results and equals b/r.

I have found that, as the value of e becomes larger, the motion of the displacer more closely approximates sinusoidal motion. To demonstrate this, I have plotted in FIG. 2B the value of the expression $e-\sqrt{1+e^2-2e\cos\theta}$ for a value of e=2 and for a value of e=5. I also plotted the value of cos $\theta$ representing a pure sinusoidal motion. It is apparent from FIG. 2B that when e is 5 or greater the difference between perfect sinusoidal motion and the motion of a displacer in an embodiment of the invention is minimal. It is also apparent that the boundary conditions are identical. Furthermore, the motion of a piston with a crank and connecting rod linkage means is also not purely sinusoidal.

Referring to FIG. 2A, the phase of the displacer 28 may be varied by moving the anchor pin 38 along a locus formed by a circle of radius b centered at the axis of rotation of the crankshaft 20. Movement of the anchor point 38 along this locus does not change either variable b or r. It does, however, change $\beta$ in direct proportion to the angular adjustment of the anchor 38.

I have mathematically determined that as $\beta$ is varied from $$-\frac{\pi}{2} \text{ to } +\frac{\pi}{2},$$

the phase angle between the displacer and the piston goes from $\pi/2$ to 0.

Additionally, outward radial movement of the anchor point 38 or drawing the band through the anchor point 38 will lower or change the average position of the displacer. Thus, the position of the anchor or the length of the band can be radially adjusted to adjust the average position of the displacer 28.

Figure 3:
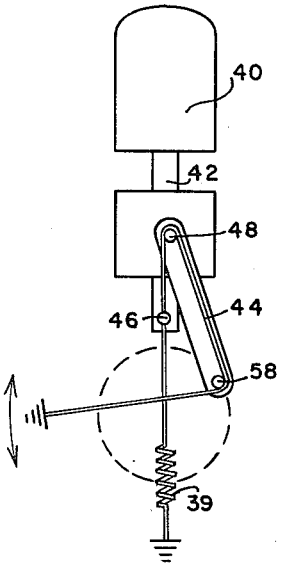
FIGS. 3 and 4 are alternative embodiments of the invention which, like the embodiment of FIG. 1, have one end of the band anchored to the housing.

FIG. 3 illustrates an embodiment of the invention which is quite similar to that of FIG. 1 with the exception that the direction of the forces applied by the band and the spring are interchanged and the spring is grounded to the housing. The spring 39 exerts a bias in the downward direction on the displacer 40 through its center displacer rod 42. The band 44 extends upwardly from its connection point 46 to the central displacer rod 42 and then extends slideably over bearing surfaces 48 and 50, which are the same bearing surfaces utilized in FIG. 1. Thus, in the embodiment of FIG. 3, the band 44 moves the displacer upwardly while the spring 39 urges it downwardly but otherwise the motion and operating characteristics are similar to those of the embodiment of FIG. 1.

Figure 4:
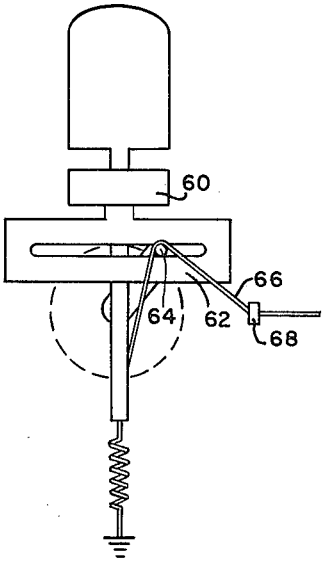

FIG. 4 illustrates a Stirling engine in which the piston 60 is linked through a conventional scotch yoke mechanism 62. It is at the slot pin 64 that the bearing surface is formed across which the band 66 slideably extends to connection with an anchor 68 mounted to the housing. This embodiment utilizes a single bearing surface.

Figure 5:
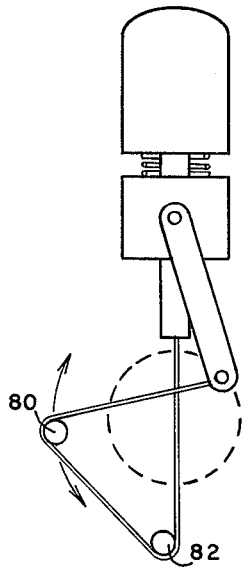
FIGS. 5, 6 and 7 are alternative embodiments of the invention in which the band is anchored to the linkage means which connects the rotating crankshaft to the piston and having intermediate bearing surfaces mounted to the housing.
Figure 7:
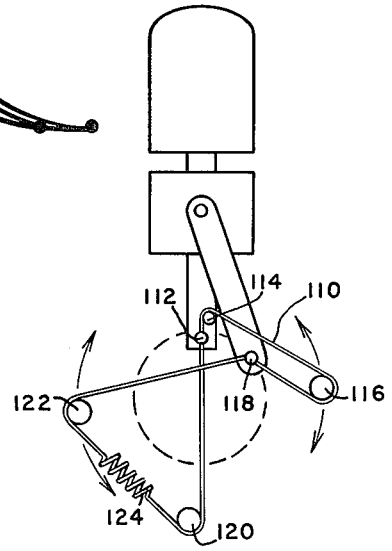
Figure 6:
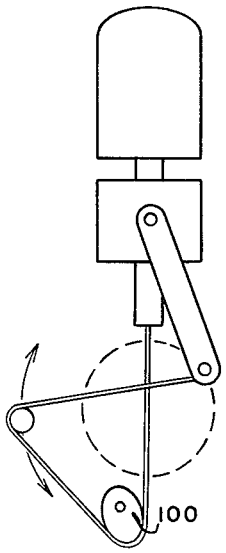

In the embodiments of FIGS. 5, 6 and 7 the band extends from the displacer to attachment at the linking means which links the power piston to the rotating shaft. The band extends slideably across two bearing surfaces which are mounted to the housing.

In FIG. 5 the bearing surfaces 80 and 82 are of the type described in connection with the embodiments of FIGS. 1-4.

The embodiment of FIG. 6 is like that of FIG. 5 except that one of the bearing surfaces 100 is a roller having an eccentric shape. The eccentric shape can be used to modify the displacer motion, for example to cause it to more closely approximate perfect sinusoidal motion or to create a dwell.

With the embodiment of FIG. 6 a band which matingly meshes with the eccentric roller 100 should be used in order to maintain the proper phase of the motion modifications. Thus, the mating is important where the motion modifications introduced by the eccentric are to be positioned at a particular angular relationship to the displacer cycle. With this embodiment as well as the other embodiments, the preferred band is a timing belt comprising a rubber based material with fabric or steel reinforcement and formed with cogs or teeth.

In the embodiment of FIG. 7, the band 110 is connected to the displacer at its one end 112, slideably extends over the bearing surfaces 114 and 116 which are mounted to the housing of the engine and then is anchored at the crank pin 118. A second band is also used extending between the same points of attachment but along a different path. It extends across an additional pair of bearing surfaces 120 and 122. The second band has an intermediate tension spring 124 and together with the spring serves as a dynamic biasing means for biasing the displacer with a downward force.

In these embodiments of the invention it is not essential that a particular bearing surface or anchor for the band be located at the crank pin. They may be located at any position along the linkage means which joins the rotating crank to the piston. For example, referring to the embodiments of FIG. 1, positioning of the bearing surface closer to the wrist pin 24 would reduce the stroke of the displacer 28.

Similarly extensions can be formed on the linkage means to provide increased stroke.

It should also be noted that any anchor which is mounted to the crankshaft must be rotatably mounted to avoid winding up the band as the crankshaft rotates.

It can therefore be seen that a novel linkage means is disclosed which is capable of being formed in a variety of embodiments without departing from the spirit of the invention.

I claim:

1. In an apparatus of the type having at least two reciprocating bodies mounted to a first part comprising a support frame, a first one of said reciprocating bodies being driven in reciprocation by means of a rotating shaft linked to said first body by a second part comprising a linkage means for converting between rotary motion and reciprocation, the improvement comprising an apparatus for driving the second one of said reciprocating bodies at the same frequency but out of phase with the first body, said apparatus comprising:

(a) biasing means linked to said second body for applying a bias force upon said second body urging it in one direction of its reciprocation; and (b) a flexible band secured at a place along its length to said second body and extending away from said second body in a direction for applying a force opposite to said biasing force, said band secured at another place along its length to one of said parts of said apparatus and extending slideably across at least one bearing surface intermediate its secured places, said bearing surface formed on still another of said parts of said apparatus which is different from the part to which the band is secured.

2. An apparatus in accordance with claim 1 wherein the other part of said apparatus to which said band is secured is said support frame.

3. An apparatus in accordance with claim 2 wherein said linkage means comprises a crank formed on said rotating shaft and a connecting rod pivotally mounted at its ends to said crank and said first body and wherein said band slideably extends across two bearing surfaces formed at the pivot points of said connecting rod.

4. An apparatus in accordance with claim 2 wherein said linkage means comprises a slotted yoke and rotating crank pin and wherein said bearing surface is formed at said crank pin.

5. An apparatus in accordance with claim 1 wherein the other part of said apparatus to which said band is secured is an anchor which is rotatably mounted to said linkage means.

6. An apparatus in accordance with claim 5 wherein said bearing surface is mounted to said support frame.

7. An apparatus in accordance with claim 6 wherein said linkage means comprises a crank formed on said rotating shaft and a connecting rod pivotally mounted at its ends to said crank and said first body and wherein said band slideably extends across two bearing surfaces both mounted to said support frame.

8. An apparatus in accordance with claim 7 wherein one of said bearing surfaces comprises a rotatably mounted eccentric roller.

9. An apparatus in accordance with claim 8 wherein said roller and said belt are matingly meshed.

10. An apparatus in accordance with claim 6 wherein said linkage means comprises a crank formed on said rotating shaft and a connecting rod pivotally mounted at its ends to said crank and said first body and wherein said band also slideably extends over a second bearing surface formed at said crank.

11. An apparatus in accordance with claim 1 wherein one of said parts to which said band is secured is releasable and adjustably translatable for controllably varying the phase difference between said reciprocating bodies.

12. In a crank type Stirling cycle engine of the type having a first part comprising a cylinder housing, a shaft rotatably mounted to said housing, a power piston slideably mounted for reciprocation in a cylinder formed in said housing and linked to said shaft by means of a second part comprising a linkage means for converting reciprocating motion to rotary motion and a displacer piston slideably mounted in a cylinder formed in said housing, the improvement comprising an apparatus for driving said displacer at the same frequency but out of phase with said power piston and comprising:

(a) a biasing means linked to said displacer for applying a bias force upon said displacer urging it in one direction of its reciprocation; and (b) a flexible band, secured at a place along its length to said displacer and extending in a direction for applying a force on said displacer opposite to said biasing force and secured at another place along its length to an anchor mounted on one of said parts of said apparatus, said band extending slideably across at least one bearing surface intermediate its secured places, said bearing surface formed on still another part of said apparatus which is different from the part to which the band is secured.

13. An apparatus in accordance with claim 12 wherein said anchor is mounted to said cylinder housing and said bearing surface is mounted to said linkage means.

14. An apparatus in accordance with claim 13 wherein said linkage means comprises a crankshaft and connecting rod and said band extends slideably over two bearing surfaces each one at a different pivot point of said connecting rod.

15. An apparatus in accordance with claim 14 wherein said anchor is releasably fixed to said housing and adjustably moveable to other positions.

16. An apparatus in accordance with claim 15 wherein the position of said anchor is angularly adjustable with respect to the axis of said crankshaft for permitting adjustment of the phase difference between said displacer and said power piston.

17. An apparatus in accordance with claim 15 wherein said anchor is radially adjustable relative to the axis of said crankshaft for varying the average position of the displacer.

18. An apparatus in accordance with claim 15 wherein said anchor is adjustably positionable on said housing both radially and angularly with respect to the axis of said crankshaft for adjusting both the average position and the phase difference between said displacer and said power piston.

19. An apparatus in accordance with claim 12 wherein said anchor is mounted to said linkage means and said bearing surface is mounted to said housing.

20. An apparatus in accordance with claim 19 wherein said linkage means comprises a crankshaft and connecting rod.

21. An apparatus in accordance with claim 20 wherein said band also extends slideably across a second bearing surface mounted to said crank.

22. An apparatus in accordance with claim 20 wherein said band extends slideably across a second bearing surface which is also mounted to said housing.

23. An apparatus in accordance with claim 22 wherein one of said bearing surfaces comprises a rotatably mounted roller.

24. An apparatus in accordance with claim 23 wherein said roller and said band are matingly meshed.

25. An apparatus in accordance with claim 24 wherein said roller is eccentric for modifying the motion characteristics of said displacer.

* * * * *